United States Patent [19]

Takahashi

[11] Patent Number: 4,957,377

[45] Date of Patent: Sep. 18, 1990

[54] ELECTRONIC APPARATUS HAVING A PRINTING FUNCTION

[75] Inventor: Tsutomu Takahashi, Kawasaki, Japan

[73] Assignee: Canon Kabushiki Kaisha, Tokyo, Japan

[21] Appl. No.: 346,303

[22] Filed: May 2, 1989

Related U.S. Application Data

[63] Continuation of Ser. No. 86,189, Aug. 14, 1987, abandoned, which is a continuation of Ser. No. 790,208, Oct. 22, 1985, abandoned.

[30] Foreign Application Priority Data

Oct. 31, 1984 [JP] Japan ..... 227980
Oct. 31, 1984 [JP] Japan ..... 227981
Oct. 31, 1984 [JP] Japan ..... 227982

[51] Int. Cl.[5] ..... B41B 27/46

[52] U.S. Cl. ..... 400/50; 400/61; 400/76; 400/82; 400/110

[58] Field of Search ..... 400/171, 109–111, 400/50–53, 61–64, 76–77, 82; 364/920.4

[56] References Cited

U.S. PATENT DOCUMENTS 4,026,403 5/1977 Inose et al. ..... 400/171
4,124,843 11/1978 Bramson et al. ..... 400/109
4,205,922 6/1980 Pascoe ..... 400/171
4,217,055 8/1980 Moon ..... 400/171
4,281,938 8/1981 Phillips ..... 400/171
4,359,286 11/1982 Barnes et al. ..... 400/171
4,400,697 8/1983 Currie et al. ..... 400/111
4,469,455 9/1984 Makita ..... 400/171
4,498,143 2/1985 Stizelecki ..... 400/110
4,521,787 6/1985 Yokota et al. ..... 346/140
4,543,631 9/1985 Kurosu et al. ..... 400/110
4,558,965 12/1985 Ueda et al. ..... 400/144
4,627,751 12/1986 Nakajima ..... 400/171

FOREIGN PATENT DOCUMENTS 0027490 4/1981 European Pat. Off. ..... 400/583
3229611 2/1983 Fed. Rep. of Germany .

OTHER PUBLICATIONS

Barnes et al., "Multi-Pass Print Algorithm" IBM Technical Disclosure Bulletin, vol. 26, No. 8, pp. 4370–4371, Jan. 1984.

Moore et al., "Optimum Order . . . Printer" IBM Technical Disclosure Bulletin, vol. 22, No. 5, pp. 1754–1755, Oct. 1979.

*Primary Examiner*—Eugene H. Eickholt

*Attorney, Agent, or Firm*—Fitzpatrick, Cella, Harper & Scinto

[57] ABSTRACT

A printer includes a printing unit capable of printing preset characters; a designation unit for designating a character to be printed by the printing unit; and a judgement unit for judging whether a designated character by the designation unit can be printed by the printing unit.

8 Claims, 7 Drawing Sheets

| CODE | ENGLISH TYPE WHEEL | THAI TYPE WHEEL |
|---|---|---|
| 0 | 5 | NON |
| 1 | 9 | NON |
| ---------- | | NON |
| | | NON |
| | | NON |
| 62 | 15 | 15 |
| 63 | 17 | 17 |
| 64 | 19 | 19 |
| 65 | NON | 10 |
| 66 | NON | 12 |
| ---------- | | |

ELECTRONIC APPARATUS HAVING A PRINTING FUNCTION

This application is a continuation of application Ser. No. 086,189 filed Aug. 14, 1987, which is a continuation of parent application Ser. No. 790,208 filed Oct. 22, 1985, both now abandoned.

BACKGROUND OF THE INVENTION

1. Field of the Invention

The present invention relates to an electronic apparatus, and more in particular to a printer which can print more than two types of characters by interchanging printing type assembly members such as print wheels.

2. Description of the Prior Art

Such an electronic apparatus of the type using more than two types of characters necessitates visual check by the operator or typist so as to confirm which type of printing type is used for the printing type assembly member. If such visual check is not made or erroneously made, printing as desired by the operator is not achieved. For example, with an electronic apparatus capable of using both English and Thai characters, an English alphabet as desired by the operator might be erroneously printed out in the form of the Thai alphabet.

SUMMARY OF THE INVENTION

It is an object of the present invention to provide an electronic apparatus which can decide whether a desired character type can be printed by print means currently mounted on the electronic apparatus.

It is another object of the present invention to provide an electronic apparatus capable of mounting several types of print wheels and deciding whether the designated character can be printed by a print wheel currently mounted on the electronic apparatus.

It is a further object of the present invention to provide an electronic apparatus capable of deciding whether an input character coincides with the character type of the printing type assembly member currently mounted on the electronic apparatus.

It is a still further object of the present invention to provide an electronic apparatus capable of selecting a suitable character table for looking up a correspondence between an input character and a printing type of the printing type assembly member currently mounted on the electronic apparatus.

It is another object of the present invention to provide an electrical apparatus capable of printing characters of different languages by using print wheels each being used for a particular one of a plurality of languages.

It is a further object of the present invention to provide an electronic apparatus having control means for performing a suitable processing when a character which is not available is instructed to be printed.

DETAILED DESCRIPTION OF THE PREFERRED EMBODIMENTS

Figure 1:
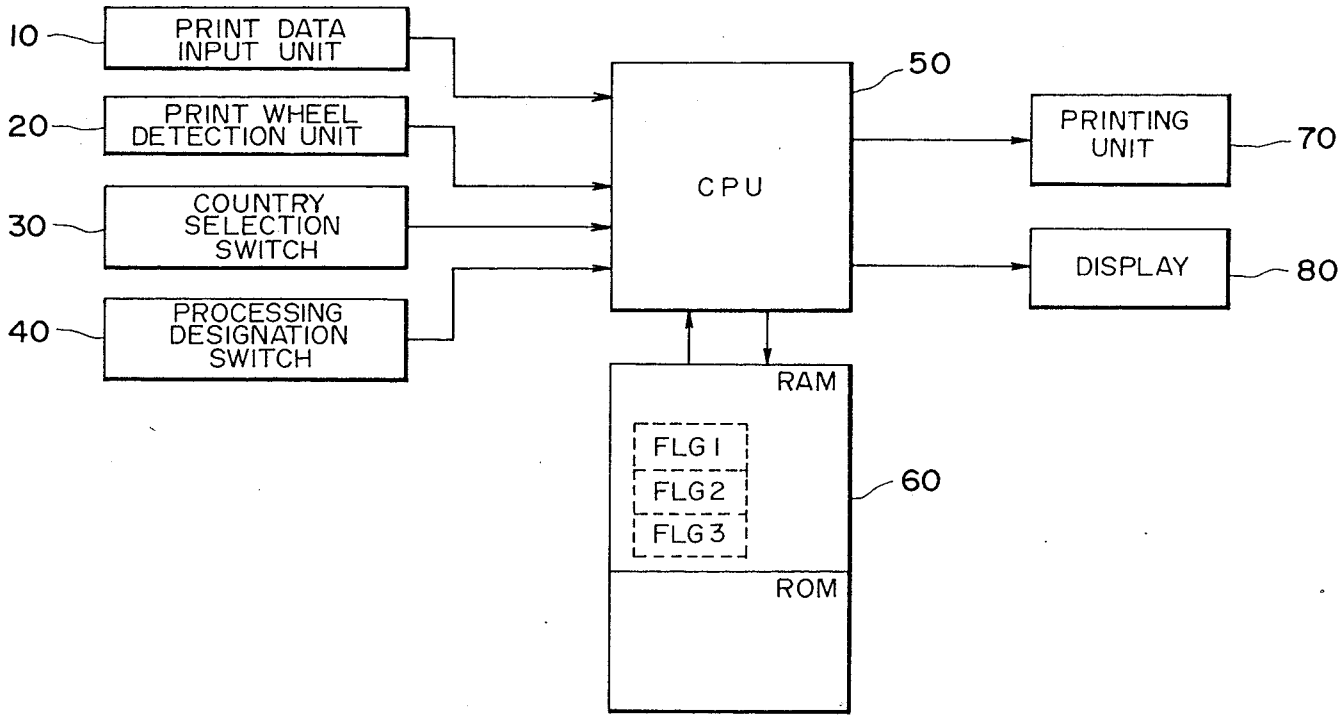
FIG. 1 is a block diagram showing an overall construction of a typical embodiment of the printer according to the present invention.

FIG. 1 is a block diagram showing the overall arrangement of a typical embodiment according to the present invention. First, an outline of the present invention will be given.

A Central Processor Unit (CPU) 50 is supplied with print data from a print data input unit 10. The data is converted, for example, into a Thai character code or English character code based upon a designation by a country selection switch 30. The country selection switch 30 is a switch having a function for the operator or typist to select either English language or Thai language and supply the selected result to the CPU 50 in the form of binary code. The data from the print data input unit 10 may include two types of data; i.e., data directly input by the operator or typist through the keyboard or data transmitted from a host computer. A print wheel detection unit 20 makes the CPU 50 know what type of a print wheel is mounted on the printer. A processing designation switch 40 is a switch by which the operator designates either processing to transfer a space code to a printing unit 70 or processing to inhibit printing, if a print wheel 21 is not provided with a printing type corresponding to print data from the print data input unit 10. Such designation is effected by supplying binary coded data to the CPU 50.

Figure 2:
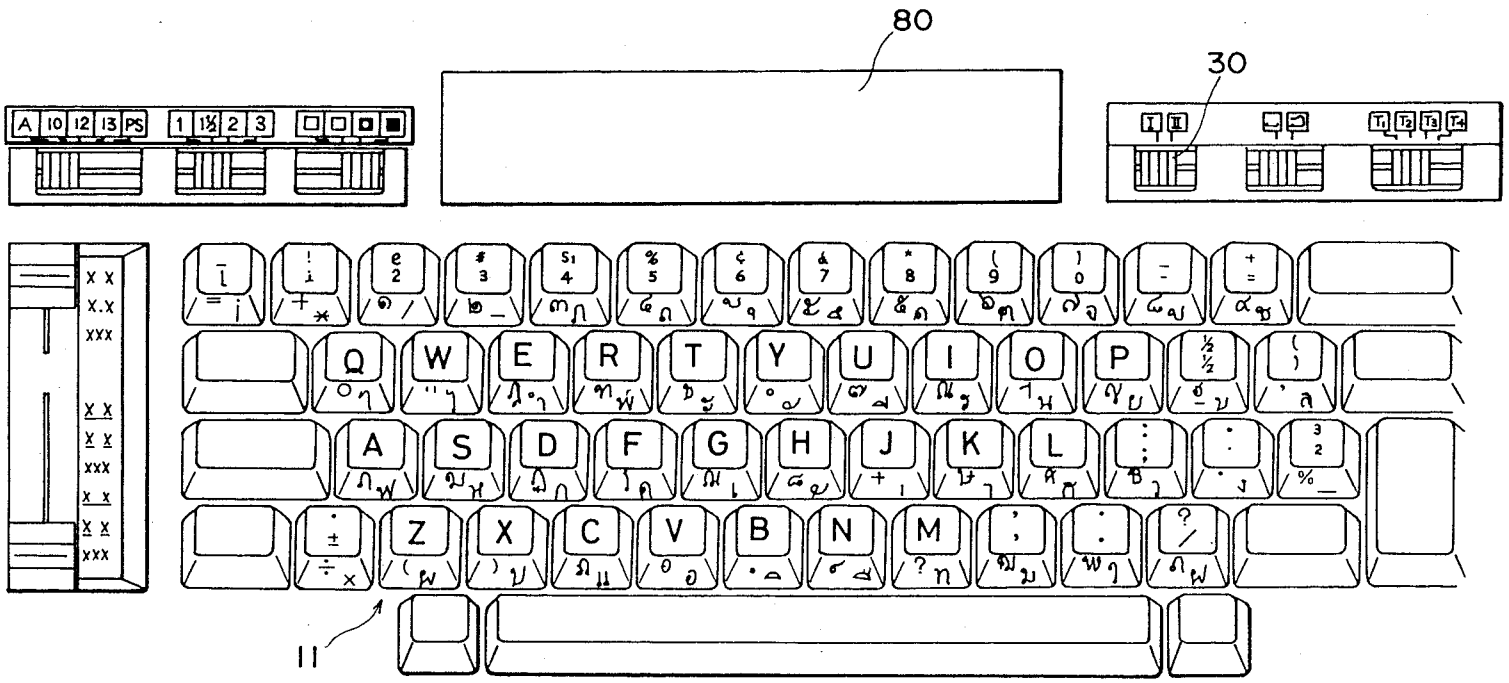
FIG. 2 shows an example of a key arrangement of a typewriter using the printer of the present invention and capable of printing both English and Thai characters.
Figure 3:
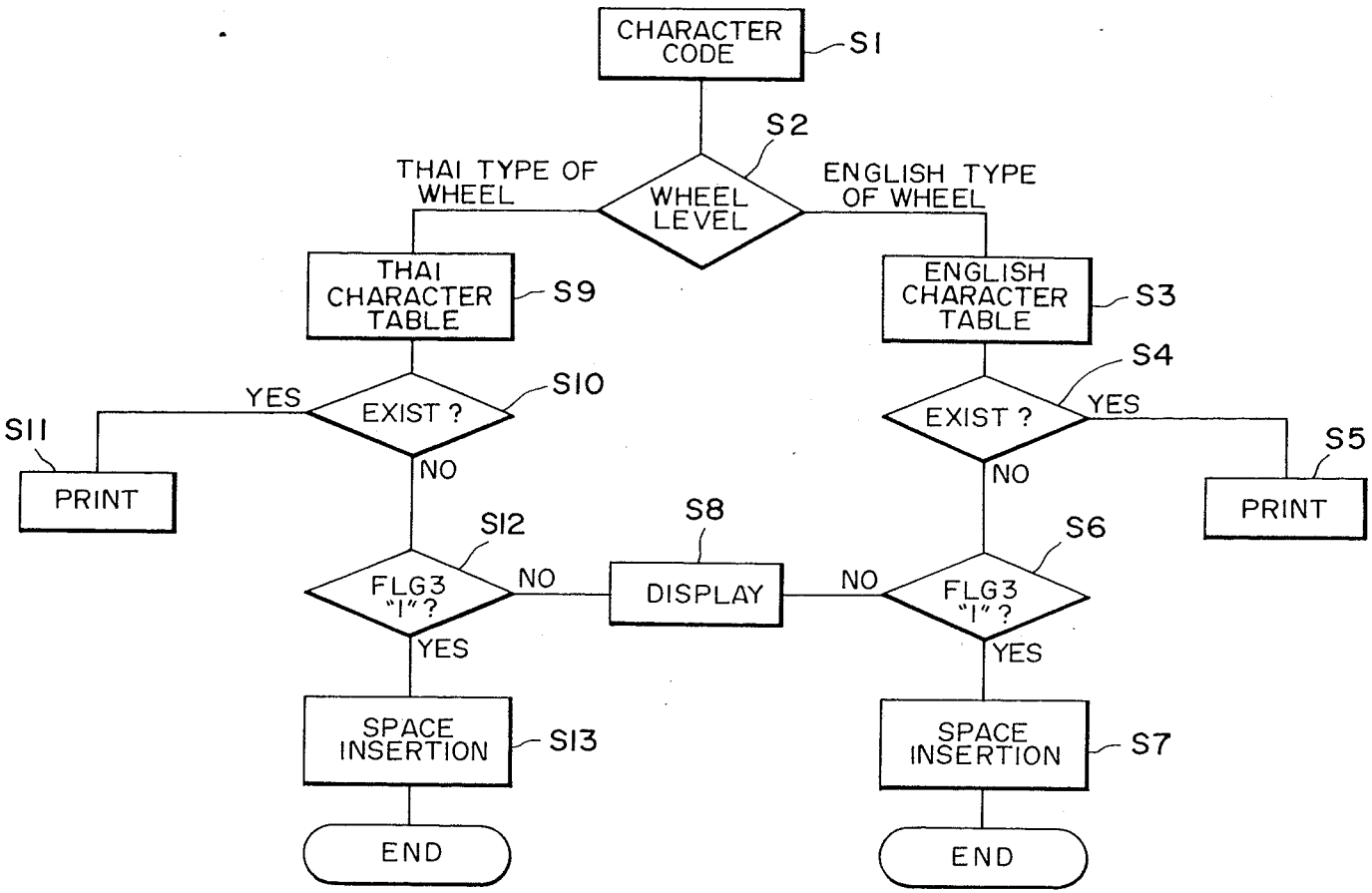
FIG. 3 is a flow chart showing a first embodiment of the processings executed by the CPU according to the present invention.

Print wheel information, information from the country selection switch 30 and information from the processing designation switch 40 respectively received by the CPU 50 are stored in FIGS. 1, 2 and 3 of a RAM constituting a main memory 60. The RAM also serves as a temporary data storage area. A ROM constituting the main memory 60 stores the processing programs. References 70 and 80 represent respectively the printing unit and a display for printing and displaying based upon the operation result of the CPU 50.

FIG. 2 illustrates an example of a key arrangement of the keyboard of a typewriter using the printer of this invention and capable of printing both English and Thai characters. The description therefore is confined only to a scope necessary for understanding the embodiments of the invention. In the figure, each key top of the keys of a key group 11 is provided with a particular English character indication for an English character input mode, while each slanted front portion of the keys is provided with a particular Thai character indication for a Thai character input mode. The mode selection of English/Thai character input is effected by the country selection switch 30 mounted on the upper right portion of the key group 11. The display 80 may be a liquid crystal display on which display information to be generated by a character generator (not shown) is displayed.

FIG. 3 is a flow chart showing an example of the processings executed by the CPU according to the present invention. As seen from the flow chart, the CPU 50 reads a character code at step S1. At step S2, the CPU 50 reads FLG1 of the RAM to judge whether the print wheel mounted on the printing unit 70 is for English character or Thai character. If it is an English character print wheel, an English character table is looked up at step S3. At step S4, the presence or absence of a printing type address for the input character code is checked. If present, printing is carried out at step S5. If absent, step S6 follows to judge, by referring to FLG3, whether the processing designation switch 40 has instructed to insert a space or to inhibit printing and display an indication on the display. If FLG3 shows "1", i.e., a judgement to insert a space, one space is inserted at step S7 and the processing is terminated. If FLG3 is "0" at step S7, i.e., a judgement of no corresponding printing type and hence inhibition of printing, step S8 follows to display appropriate information on the display 80.

Alternatively, if a designation of a Thai character wheel is made at step S2, then at step S9 a Thai character table is looked up to determine if there is a corresponding printing type code. If present, at step S11 printing is carried out. If absent, at step S12 it is checked whether FLG3 shows "1" or "0". In case of "1", at step S13 a space is inserted. In case FLG3 shows "0" at step S12, step S8 follows to display an appropriate indication.

Figure 4:
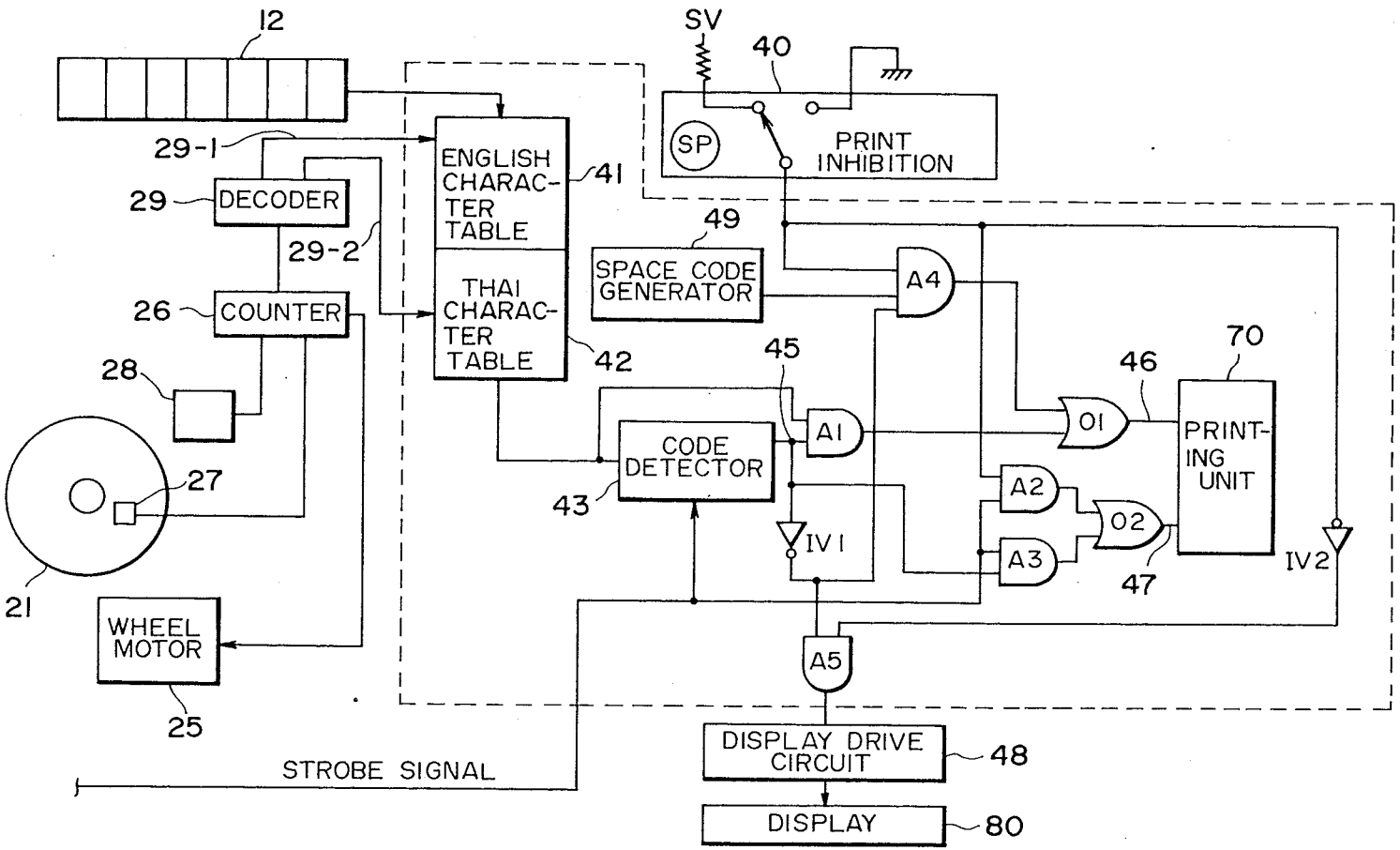
FIG. 4 is a block diagram for explaining the functions of the CPU of the first embodiment.

FIG. 4 is a block diagram for explaining the operation of the printer, wherein the portion encircled with a broken line is controlled under the CPU 50.

Figures 5, 6:
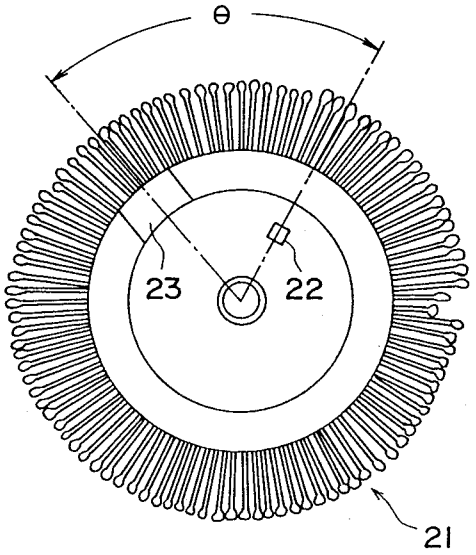
FIG. 5 is a plan view of a print wheel.
FIG. 6 shows a table for looking up character codes and corresponding printing type addresses.

In this embodiment, two types of print wheels are prepared, one for an English character print wheel and the other for a Thai character print wheel. Such a print wheel 21 is illustrated in FIG. 5. The two print wheels are distinguished from each other based upon the number of pulses to be supplied to a wheel motor 25 for turning the print wheel 21 by an angle 8 defined by a reference aperture 22 and an identification member 23.

The number of pulses supplied to the wheel motor 25 is counted by a counter 26. The counter 26 is reset by a detection signal from a home position detector 27 detecting the reference aperture 22 in the print wheel 21. The counter 26 counts up the pulses supplied to the wheel motor 25 and stops counting when the identification member 23 made of an silver sheet affixed to the print wheel comes under a position sensor 28.

A decoder 29 constituting a table selection means designates a table based upon the count of the counter 26. An output 29-1 designates the English character table 41, while an output 29-2 designates the Thai character table 42.

In the tables, the character codes which will be converted into printing type addresses of the English or Thai print wheel are correlated with respective English codes or Thai codes based upon a selection by the English/Thai character selection switch 30 on the keyboard. In FIG. 4, a memory 12 stores the character codes. The character codes for an underline, comma and bracket each has the same code for both English and Thai print wheels. However, the other characters, numerals and symbols have the different character codes for the English and Thai print wheels. If an input character code is present in a designated conversion table, then a printing type address corresponding to the character code is read out. If it is absent, then a special code is read out. Whether the input character code corresponds to a printing type address or a special code is judged by a code detector 43.

A code output of the code detector 43 is generated when the processing designation switch 40 is turned to the side representing space insertion and the code detector 43 judges a truth (a printing type address was found). In particular, when the code detector 43 determines a truth of the code read from the table, the code detector 43 supplies the read code itself to the printing unit 70 via an AND gata A1, OR gate O1 and a signal line 46. Alternatively, when the code detector 43 determines a false (a printing type address was not found), a signal on a signal line 45 is supplied to an AND gate A4 via an inverter IV1 to open the Gate A4. Therefore, a space code from a space code generator 49 is supplied to the printing unit 70 via the OR gate 01. Printing starts upon reception of a print command on a signal line 47 which is activated by a strobe signal via an AND gate A3 and OR gate 02, the strobe signal being generated every time one character is input from the print data input unit 10.

If the processing designation switch 40 is turned to the side representing print inhibition, the space code generated by the space code generator is inhibited by the AND gate A4. Therefore, although the code detector 43 determines a false, the space code is not supplied to the printing unit 70. Similarly, since an L signal on the signal line 45 is being supplied to the AND gate A3, the print command signal is not generated at a rise of a strobe signal, thereby inhibiting printing by the printing unit 70. In this case, since the signal on the signal line 45 and the signal from the processing designation switch 40, respectively via the inverter IV1 and an inverter IV2, are supplied to an AND gate A5, a display drive circuit 48 is energized to display on the display 80 an indication of no printing type.

According to the above embodiment, when the code detector determines an absence of printing type (or false), either a space is inserted by the printing unit or printing is inhibited to display an indication of no printing type, based upon a processing designation by the processing designation switch 40. With a space inserted on a recording sheet, a character different in type can be printed thereafter or a hand written character can be inserted In this case, times when a space is inserted can be indicated to the operator by driving the printing unit 70 by a signal on the signal line 45 without passing through the circuit elements IV1 and A5

Figure 7:
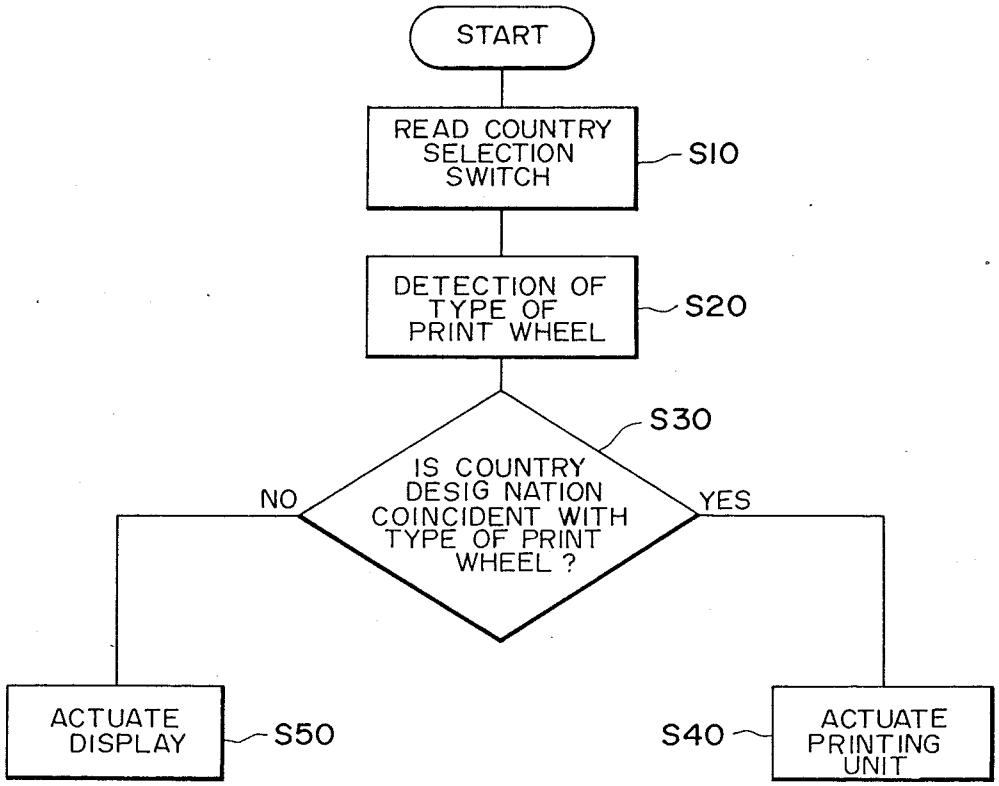
FIG. 7 is a flow chart showing a second embodiment of the processings executed by the CPU according to the present invention.

FIG. 7 is a flow chart showing a second embodiment of the processings executed by the CPU 50 according to the present invention. As seen from the flow chart, the CPU 50 reads at step S10 the contents of FLG1 of the RAM to judge whether the print character as desired by the operator is English or Thai. At steps 20, FLG2 of the RAM is read to check whether the print wheel mounted on the printing unit 70 is for an English character print wheel or a Thai character print wheel. At step S30, it is judged whether the designation by the country selection switch is coincident with the type of print wheel. If coincident, the printing unit is actuated at step S40. If not coincident, then at step S50 the display is actuated to urge the operator or typist to replace with the other print wheel.

Figure 8:
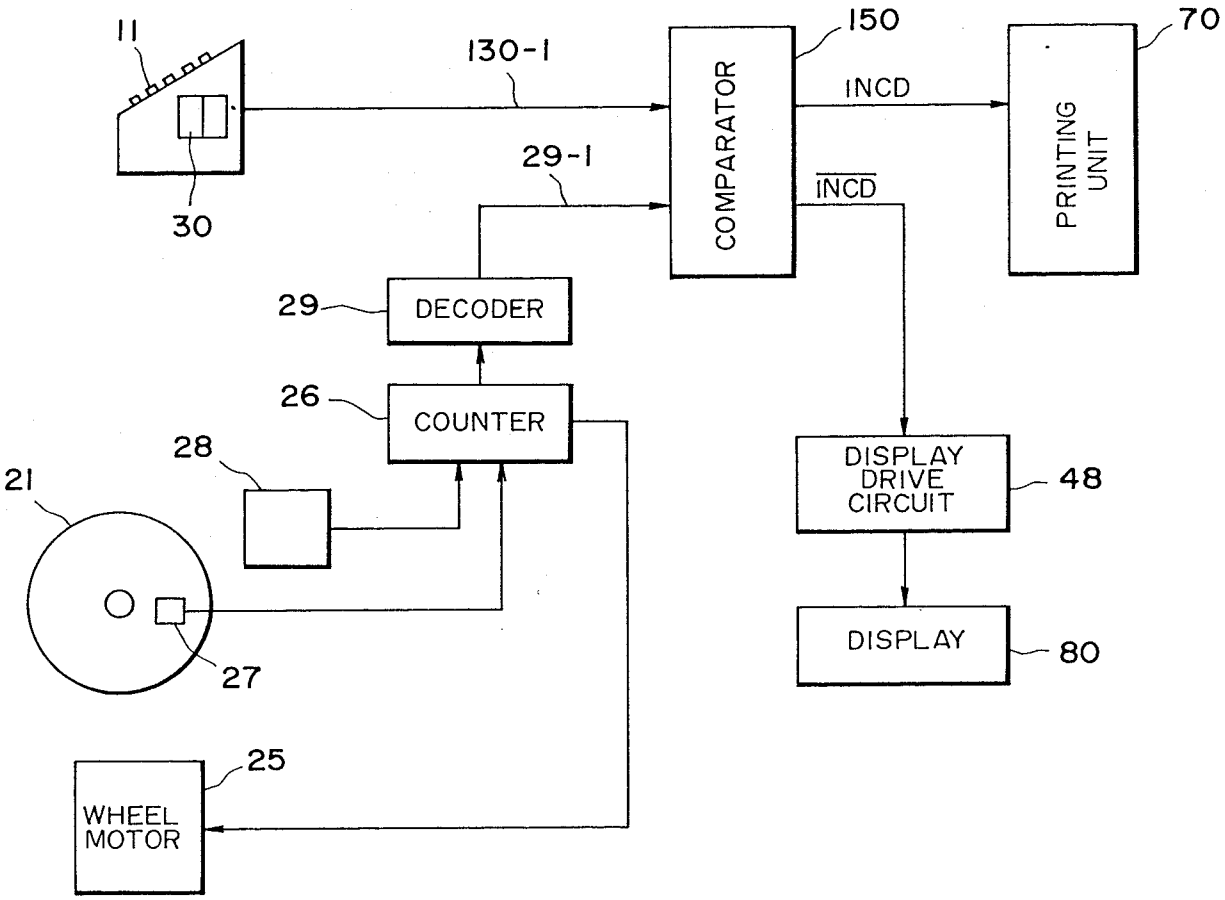
FIG. 8 is a block diagram for explaining the functions of the CPU of the second embodiment.

FIG. 8 is a block diagram for explaining the function of the CPU wherein a circuit for the print wheel detection unit 20 is shown in detail.

In this embodiment, two types of print wheels are prepared, one for an English character print wheel and the other for a Thai character print wheel. Such a print wheel 21 is illustrated in FIG. 5. The two print wheels are distinguished from each other with the help of a counter 26 similarly to the first embodiment. A decoder 29 outputs "1" when the count of the counter 26 is a predetermined value and outputs "0" at a different value from the predetermined one, so that the type of print wheel 21 mounted is detected.

An English/Thai character selection switch 30 on a keyboard 11 delivers an output "1" for the English mode and an output "0" for the Thai mode. Reference 130-1 designates an output signal line of the switch 30. A comparator 150 compares the signals on the signal lines 130-1 and 29-1 to output "1" on an INCD line for actuation of a printing unit 70 when a coincidence between the signals is detected, that is, when a print wheel corresponding to the input mode is mounted on the typewriter.

Alternatively, if a coincidence is not detected and hence it is necessary to replace with the other print wheel or switch the country selection switch 30, a display drive circuit 48 is driven to display on a display 80 in indication urging such action by the operator.

As seen from the above description of the invention, if a printing type corresponding to an input character code is not present in the print wheel, a space is inserted on a recording sheet so that a character different in type can be printed thereafter on the space or a hand written character can be inserted. As particularly shown in the embodiments using a printer for use with both Thai and English characters, to allocate the same character code for identical characters or symbols, and a different character code (printing type address) for different character types, gives an advantageous effect. In case the corresponding printing type is not found in the print wheel, the provision of a function to inhibit printing and notify the operator or typist of such a fact enables to avoid erroneous operation of the printer and gives notice to the operator automatically.

In the above embodiments, two types of print wheels have been employed for English and Thai characters, however the invention is not intended to be limited thereto. It is apparent that other print wheel combinations of different character types, such as English and Arab characters, pica and elite type characters and so on may be used.

I claim:

1. A printer comprising:

designation means for designating characters to be printed;

printing means for printing characters in the same order that said characters were designated by said designation means;

judgement means for judging whether a character designated by said designation means can be printed by said printing means;

display means for displaying a message;

selection means for selecting in lieu of character printing either formation of a space or generation of a message on said display means indicating that the printing of the character is impossible, said selection means operative when said judgment means judges that the printing of the character is impossible; and control means for forming said space or generating said message in response to a selection of the selection means when said judgment means judges that the printing of the character is impossible

2. A printer according to claim 1, wherein said printing means is capable of printing characters of two languages.

3. A printer according to claim 1, further comprising a memory means for storing character designated by said designation means.

4. A printer according to claim 1, wherein said designation means is one capable of designating characters of plurality of language.

5. A printer comprising:

designation means for designating characters to be printed;

printing means, for mounting each of a plurality of printing wheels for different languages, respectively, for printing characters in the same order that said characters were designated;

discriminating means for discriminating a language of said printing wheel mounted on said printing means;

judgement means for judging whether a character designated by said designation means can be printed by a print wheel mounted on said printing means, on the basis of the discrimination result by said discrimination means;

display means for displaying a message;

selection means for selecting in lieu of character printing either formation of a space or generation of a message on said display means indicating that the printing of the character is impossible, said selection means operative when said judgment means judges that the printing of the character is impossible; and control means for forming said space or generating said message in response to a selection of the selection means when said judgment means judges that the printing of the character is impossible.

6. A printer according to claim 5, further comprising a memory means for storing character designated by said designation means.

7. A printer comprising:

input means for inputting a character of a plurality of languages;

printing means for mounting each of a plurality of printing type assembly members for different languages, respectively, for printing characters inputted by said input means in the same order that said characters are input;

designation means for designating to which language a character input by said input means belongs;

discrimination means for discriminating the language of the printing type assembly member mounted on said printing means;

judgment means for judging whether the language designated by said designating means coincides with any of the languages of a character to be printed by said printing type assembly member mounted on said printing means on the basis of the discrimination result by said discrimination means;

display means for displaying a message;

selection means for selecting in lieu of character printing either formation of a space or generation of a message on said display means indicating that the printing of the character is impossible, said selection means operative when said judgment means judges that the printing of the character is impossible; and control means for forming said space or generating said message in response to a selection of the selection means when said judgment means judges that the printing of the character is impossible.

8. A printer according to claim 7, comprising a memory means for storing character inputted by said input means.

* * * * *

UNITED STATES PATENT AND TRADEMARK OFFICE

CERTIFICATE OF CORRECTION

PATENT NO. : 4,957,377

DATED : September 18, 1990

INVENTOR(S) : Takahashi, et al.

It is certified that error appears in the above-identified patent and that said Letters Patent is hereby corrected as shown below: Title page:

[30] Foreign Application Priority Data:

"Japan .... 227980" should read --Japan .... 59-227980--.

"Japan .... 227981" should read --Japan .... 59-227981--.

"Japan .... 227982" should read --Japan .... 59-227982--.

COLUMN 3:

Line 39, "angle 8" should read --angle θ--.

COLUMN 4:

Line 45, "inserted In" should read --inserted. In--.

Line 48, "A5" should read --A5.--.

Line 54, "steps 20," should read --step S20,--.

UNITED STATES PATENT AND TRADEMARK OFFICE

CERTIFICATE OF CORRECTION

PATENT NO. : 4,957,377

DATED : September 18, 1990

INVENTOR(S) : Takahashi, et al.

It is certified that error appears in the above-identified patent and that said Letters Patent is hereby corrected as shown below:

COLUMN 5:

Line 65, "impossible" should read --impossible.--.

Signed and Sealed this

Twenty-first Day of July, 1992

*Attest:*

DOUGLAS B. COMER

*Attesting Officer*

*Acting Commissioner of Patents and Trademarks*